US005514429A

United States Patent [19]

Kamihgaraguchi et al.

[11] Patent Number: 5,514,429

[45] Date of Patent: May 7, 1996

[54] CYLINDRICAL COMPOSITE PAPERBOARD CUSHION CORE AND PROCESS FOR PRODUCING SAME

[75] Inventors: Hiromi Kamihgaraguchi, Tokyo; Tsunehisa Shigetani, Kasagai, both of Japan

[73] Assignee: New OJI Paper Co., Ltd., Tokyo, Japan

[21] Appl. No.: 151,837

[22] Filed: Nov. 15, 1993

[30] Foreign Application Priority Data

Nov. 18, 1992 [JP] Japan ..... 4-308790

[51] Int. Cl.[6] ..... B65H 75/08

[52] U.S. Cl. ..... 428/34.2; 428/36.91; 428/314.8; 428/326; 428/327; 428/342; 428/906; 138/132; 138/137; 242/610; 162/121; 162/122; 162/127; 162/164.1

[58] Field of Search ..... 428/34.2, 34.3, 428/314.8, 315.9, 511, 535, 326, 327, 340, 342, 402.2, 402.21, 402.22, 913, 906, 36.91; 138/132, 140, 137; 162/158, 164.1, 164.7, 164.6, 168.2, 169, 127, 118, 121, 122; 242/610.4, 610, 610.1

[56] References Cited

U.S. PATENT DOCUMENTS

| | | | |
|---|---|---|---|
| 3,556,934 | 1/1971 | Meyer | 162/169 |
| 4,133,688 | 1/1979 | Sack | 162/158 |
| 4,379,729 | 4/1983 | Cross | 156/73.6 |
| 4,745,097 | 5/1988 | Maekawa et al. | 503/209 |

FOREIGN PATENT DOCUMENTS

| | | |
|---|---|---|
| 0421400A2 | 4/1991 | European Pat. Off. . |
| 8704557.5 | 9/1987 | Germany . |
| 52-26823 | 2/1977 | Japan . |
| 77039924 | 6/1977 | Japan . |
| 52-39924 | 10/1977 | Japan . |
| 80018116 | 5/1980 | Japan . |

OTHER PUBLICATIONS

European Search Report for application 93118445.1 dated Mar. 24, 1994.

*Primary Examiner*—Ellis P. Robinson
*Assistant Examiner*—Rena L. Dye
*Attorney, Agent, or Firm*—Armstrong, Westerman, Hattori, McLeland & Naughton

[57] ABSTRACT

A cylindrical composite paperboard cushion core for winding a sheet material therearound without forming undesirable stepwise marks thereon, comprises a cylindrical paperboard substrate and a cushion layer formed on the cylindrical paperboard substrate from an expanded paper sheet having a density of 0.1 to 0.4 g/cm$^3$, the expanded paper sheet being formed by forming an unexpended paper sheet containing therein a plurality of expansible microcapsules each having a volatile liquid core contained in a thermoplastic resin shell and capable of starting an expansion at a temperature of 80° C. to 200° C., and heating the unexpanded paper sheet at the expansion-starting temperature of the microcapsules or higher, to cause the paper sheet to be expanded.

8 Claims, 1 Drawing Sheet

CYLINDRICAL COMPOSITE PAPERBOARD CUSHION CORE AND PROCESS FOR PRODUCING SAME

BACKGROUND OF THE INVENTION

1) Field of the Invention

The present invention relates to a cylindrical composite paperboard cushion core and a process for producing the same. More particularly, the present invention relates to a cylindrical composite paperboard cushion core provided with an outer cushioning layer formed from an expanded paper sheet with a low density and having a high reusability and a satisfactory combustibility.

2) Description of the Related Art

It is known that paperboard tubes, thermoplastic resin tubes, for example, polypropylene resin tubes and polyvinyl chloride resin tubes, or composite tubes in which cushioning sheets are wound on the outer surfaces of the above-mentioned tubes, are usable as a winding core for paper sheets, viscose films (cellophane), thermoplastic resin films, various tapes, metallic foils and fabrics.

As a special winding core for photographic printing paper sheets and for winding few layers, there is a cushion paperboard core comprising a cylindrical paperboard substrate and a foamed thermoplastic resin cushion sheet attached to an outer surface of the cylindrical substrate. This type of cushion paperboard core is effectively utilized to prevent a formation of undesirable stepwise marks on the sheet wound around the core. The stepwise marks are derived from a terminal edge of the wound sheet placed on the outer surface of the core. The terminal edge forms a stepwise difference in level on the outer surface of the core. The cushioning layer allows the terminal edge of the wound sheet to be embedded in the cushioning layer so as to eliminate the stepwise difference and thus the formation of the stepwise marks on the wound sheet can be prevented.

Also, even when the sheet, for example, viscose film, is wound around a core under uneven tension, the cushioning layer effectively prevents a formation of undesirable uneven strain on the sheet.

As the conventional cushion sheet, usually foamed synthetic polymer films or sheets, for example, foamed polystyrene sheets or foamed polyethylene sheets, having a density of 0.08 to 0.16 g/cm$^3$, are employed, because these foamed sheets exhibit a satisfactory cushioning effect and processability.

For example, when a compressive stress of 1 kgf/cm$^2$ is applied to a foamed polystyrene sheet having a density of 0.09 g/cm$^3$ in accordance with the static compression testing method of Japanese Industrial Standard (JIS) Z 0234, a compressive strain of about 40% is generated in the foamed sheet. Thus the foamed sheet exhibits a high cushioning effect. However, the conventional foamed cushion sheets are disadvantageous in that they have a high resistance to natural decomposition, and when burnt, harmful combustion gas and smoke are generated so as to pollute the environment. Also, the conventional foamed synthetic polymer cushion sheets are difficult to reuse.

As a conventional paperboard material having a high cushioning effect, a corrugated paperboard cushion sheet, especially, a one side-corrugated paperboard cushion sheet, is known. However, this conventional paperboard cushion sheet is disadvantageous in that processability is poor and when used as a cylindrical winding core, the surface of the paperboard sheet is too rough and uneven.

A conventional nonwoven fabric having a low density exhibits a high cushioning property. However, when employed to produce a cylindrical paperboard core, the nonwoven fabric exhibits a poor processability due to a poor mechanical strength thereof and a low resistance to ply separation.

JP-B-52-39,924 discloses a process for producing a cushioning paperboard substrate having a density of 0.37 to 0.67 g/cm$^3$. In this process, a paperboard sheet is formed from a pulp slurry containing fine, porous inorganic particles.

Also, JP-B-55-18,116 discloses a porous paperboard plate having a density of 0.5 g/cm$^3$ and produced by using expandable microcapsules. This paperboard plate is useful as a vibration diaphragm for a speaker. However, a paper sheet having a very low density of 0.1 to 0.4 g/cm$^3$ which is comparable to that of conventional foamed polystyrene sheet, has not previously been known.

SUMMARY OF THE INVENTION

An object of the present invention is to provide a cylindrical composite paperboard cushion core having a cushioning paper sheet layer, useful as a winding core for sheet materials and capable of preventing formation of stepwise marks on the sheet material, and a process for producing the same.

Another object of the present invention is to provide a cylindrical composite paperboard cushion core having a high maceratability and reusability and a satisfactory combustion performance with a relatively low heat generation and no smoke or harmful gas generation, and a process for producing the same.

The above-mentioned objects can be attained by the cylindrical composite paperboard cushion core of the present invention which comprises (A) a cylindrical paperboard substrate; and (B) a cushioning layer covering an outer surface of the cylindrical paperboard substrate and comprising an expanded paper sheet having a density of 0.1 to 0.4 g/cm$^3$, the expanded paper sheet having been formed by subjecting an aqueous slurry of a mixture of pulp fibers with a plurality of expansible microcapsules each having a volatile liquid core enclosed in a thermoplastic resin shell and capable of starting an expansion at a temperature of from 80° C. to 200° C., to a paper-forming procedure, and heating the resultant paper sheet at the expansion-starting temperature of the microcapsules or higher to cause the paper sheet to be expanded.

The above-mentioned cylindrical composite paperboard cushion core can be produced by the process of the present invention which comprises the steps of;

(A) subjecting an aqueous slurry of a mixture of pulp fibers and a plurality of expansible microcapsules each having a thermoplastic resin shell and a volatile liquid core enclosed in the shell and capable of starting an expansion at a temperature of 80° C. to 200° C., to a paper-forming procedure;

(B) heating the resultant expansible paper sheet at the expansion starting temperature of the microcapsules or higher to cause the paper sheet to be expanded and to provide an expanded paper sheet having a density of from 0.1 to 0.4 g/cm$^3$; and (C) spirally coiling at least one paperboard substrate sheet and at least one expanded paper sheet superimposed on the substrate sheet to form a cylindrical composite paperboard cushion core in which a cushioning layer comprising the expanded paper sheet is formed on an outer surface of a cylindrical paperboard substrate comprising the paperboard substrate sheet.

In the process of the present invention, the expansible microcapsule-containing paper sheet is subjected preferably at a water content of 65% to 72% based on the weight of the paper sheet, to the heating step (B).

DESCRIPTION OF THE PREFERRED EMBODIMENTS

In the cylindrical composite paperboard cushion core of the invention, it is essential that a cylindrical paperboard substrate is coated by a cushioning layer comprising at least one expanded paper sheet having a density of 0.1 to 0.4 g/cm$^3$ and exhibiting a high cushioning effect (a high compressibility).

The expanded paper sheet is formed from a specific aqueous slurry of a mixture of pulp fibers with a plurality of expansible microcapsules each having a volatile liquid core enclosed in a thermoplastic resin shell, and capable of starting an expansion at a temperature of 80° C. to 200° C., by a paper-forming procedure.

In this paper-forming procedure, a microcapsule-containing wet paper sheet is formed from the aqueous pulp slurry on a paper-forming wire net, and the wet paper sheet is dehydrated in a press-dehydration manner. Then, the resultant microcapsule-containing expansible paper sheet is heated at the expansion-starting temperature of the microcapsules or higher to cause the expansible paper sheet to also be expanded.

With respect to the expanded paper sheet having a density of 0.1 to 0.4 g/cm$^3$, it was confirmed that, for example, when a compressive stress of 1 kgf/cm$^2$ was applied to an expanded paper sheet having a density of 0.2 g/cm$^3$ in accordance to a static compression testing method of Japanese Industrial Standard (JIS) Z 0234, a compressive strain of 9.8% was generated in the expanded paper sheet. Composed with this, when the same stress as mentioned above was applied to a conventional copying paper sheet having a density of 0.75 g/cm$^3$, the resultant strain was about 2.5%.

Accordingly, it is clear that the expanded paper sheet usable for the present invention exhibits a significantly higher cushioning performance than the conventional non-expanded paper sheet, and thus is useful for forming a cushioning layer of a cylindrical paperboard core.

Also, the expanded paper sheet usable for the present invention can exhibit a wet tensile strength of about 0.4 kg/15 mm or more and a dry tensile strength of about 2.5 kg/15 mm or more by adding a paper strength-enhancing agent thereto. Also, the expanded paper sheet can be sized with a conventional sizing agent and easily handled during the formation of the cylindrical composite paperboard cushion core of the present invention.

Figure 1:
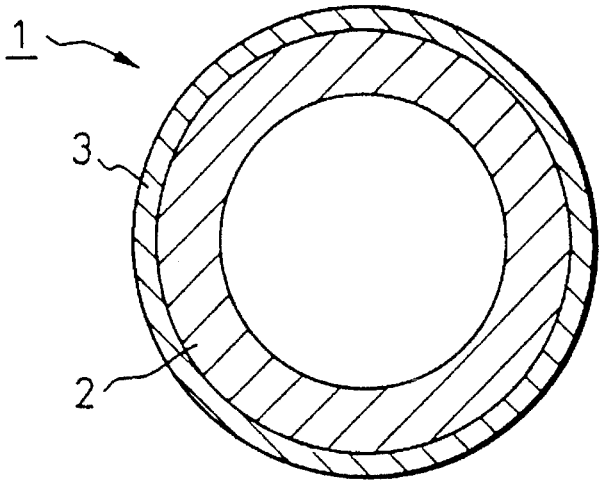
FIG. 1 is an explanatory cross-sectional profile of an embodiment of the cylindrical composite paperboard cushion core of the present invention.

Referring to FIG. 1, a cylindrical composite paperboard cushion core 1 of the present invention is composed of a cylindrical paperboard substrate 2 and a cushioning layer 3 covering an outer surface of the cylindrical paperboard substrate 2.

When a sheet material is wound around the outer surface of the cushioning layer, a terminal edge portion of the sheet material placed on the cushioning layer is embedded in the cushioning layer and a formation of undesirable stepwise marks on the sheet material due to the terminal edge can be prevented.

Figure 2:
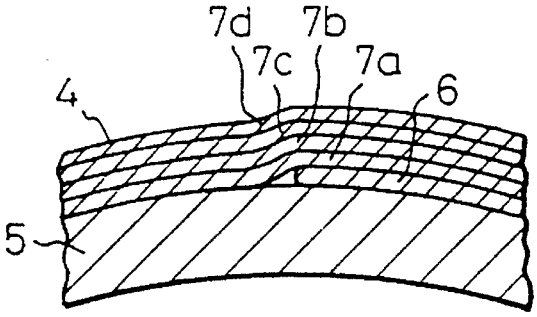
Fig.2 PRIOR ART
FIG. 2 is an explanatory cross-sectional profile of a conventional cylindrical paper-board core and a paper sheet wound around the core.

For example, referring to FIG. 2, when a sheet material 4, for example, photographic printing paper sheet, is wound around an outer surface of a conventional cylindrical paperboard core 5 having no cushioning layer, a terminal edge 6 of the wound sheet material 4 placed in direct contact with the outer surface of the cylindrical paperboard core 5 forms a stepwise difference in level on the outer surface. Accordingly, stepwise marks are generated in portions 7*a*, 7*b*, 7*c*, 7*d* of the sheet material 4 superposed on the terminal edge 6.

Figure 3:
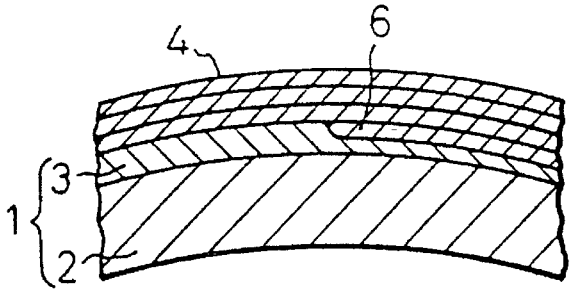
FIG. 3 is an explanatory cross-sectional partial view of an embodiment of the cylindrical composite paperboard cushion core of the present invention and a paper sheet wound around the core.

In FIG. 3, when a sheet material 4 is wound on an outer surface of a cushioning layer 3 of a cylindrical composite paperboard cushion core 1 of the present invention, a terminal edge portion 6 of the paper sheet 4 is embedded in the cushioning layer 3, and thus no stepwise difference in level is formed on the outer layer of the cushioning layer 3.

Accordingly, no stepwise marks are formed in portions of the sheet material 4 superposed on the terminal edge 6 of the paper sheet 4.

For example, to wind a photographic printing paper sheet having a thickness of about 260 μm around an outer surface of a cushioning layer of a cylindrical composite paperboard cushion core of the present invention, without generating undesirable stepwise marks on the paper sheet, it is preferable that the cushioning layer is formed from two expanded paper sheets each having a basis weight of 70 g/m$^2$ and a thickness of about 300 μm superimposed on each other or an expanded paper sheet having a basis weight of 150 g/m$^2$ and a thickness of about 600 μm, this cushioning layer allows the terminal edge portion of the photographic printing paper sheet to be completely embedded therein so as to form no stepwise difference in level on the outer layer of the cushioning layer.

When a viscose film (cellophane film) is wound, the cushioning layer is preferably formed from one or two expanded paper sheets as mentioned above and has a basis weight of 70 to 150 g/m$^2$. The cushioning layer effectively prevents a generation of strains even when wound under high tension.

Generally, the cylindrical paperboard substrate is made from at least one paperboard which is produced from waste corrugated paperboard pulp. The paperboards are classified into classes A, B and C, depending on tensile strength thereof.

The class A paperboard is produced from a mixture of the waste corrugated paperboard pulp and a usual paper-forming pulp. The class B paperboard is produced from waste corrugated paperboard pulp above. The class C paperboard is produced from a mixture of waste corrugated paperboard pulp and another waste paper pulp. The class of the paperboard to be used is variable depending on the use of the cylindrical core. The thickness of the paperboard for the cylindrical paperboard substrate is variable within the range of from 0.4 to 1.0 mm.

The pulp for forming the extended paper sheet can be selected from the group consisting of wood pulps, for example, chemical pulp and mechanical pulp which are usable for forming usual paper sheets, waste paper pulps, nonwood natural fiber pulps, for example, hemp pulps and cotton pulps, synthetic pulps, and mixtures of two or more of the above-mentioned pulps. Also, in the paper-forming procedure, the above-mentioned pulps can be employed as a mixture with at least one type of non-pulp fibers selected from organic fibers, for example, synthetic fibers, and inorganic fibers, for example, glass fibers.

Preferably, the above-mentioned pulp-non pulp fiber mixture contains 50% by weight or more of pulp. If the amount of the pulp fibers is less than 50%, the resultant expanded paper sheet sometimes exhibits an unsatisfactory appearance, hand feeling and mechanical strength.

The expansible paper sheet usable for the present invention contains a number of expansible microcapsules uniformly dispersed in a pulp fiber matrix.

The microcapsules each comprise a thermoplastic resin shell and a volatile liquid core enclosed in the shell and are capable of initiating a thermal expansion at a relatively low temperature of 80° to 200° C., preferably 100° C. to 150° C. into an enlarged diameter of about 4 to 5 times the original diameter of the microcapsules and into an expanded volume of 50 to 100 times the original volume of the microcapsules.

Preferably, the expansible microcapsules have an average size of 10 to 30 μm. The volatile liquid core comprises at least one volatile organic liquid compound having a boiling temperature of from −12° C. to 70° C., more preferably from 10° C. to 50° C., and selected from the group consisting of, for example, isobutane, pentane, petroleum ether, hexane, halogenated hydrocarbon compounds having the above-mentioned low boiling temperature, and methylsilane. The shells comprise a thermoplastic resin comprising at least one resin selected from the group consisting of homopolymers of vinylidene chloride, acrylonitrile, acrylic esters and methacrylic esters, and copolymers of two or more of the above mentioned monomers.

When the microcapsules are heated at the expansion-starting temperature of the microcapsules or higher, the thermoplastic resin shells are softened and the liquid cores are vaporized so as to generate a high vapor pressure in the shell within a short time. The shells are expanded by the high pressure of the vapor generated in the shells so as to expand the microcapsule-containing paper sheet. The resultant expanded paper sheet has a number of pores formed by the expanded microcapsules and maintained in an expanded form even after cooling to room temperature. The vapor generated in the shells escapes away through the expanded shells. The expanded paper sheet exhibits a high cushioning effect or a high compressibility.

The expansible microcapsules are available, for example, under trademarks of Matsumoto Microsphere F-30D, F-30GS, F-20D, F-50D, and F-80D from Matsumoto Oil and Fat Co., and Expancell WU and DU from Nihon Filite Co. Of course, the expansible microcapsules usable for the present invention are not restricted to those mentioned above.

The expansible paper sheet contains the expansible microcapsules preferably in an amount of 1 to 40%, more preferably 3 to 20% based on the weight of the pulp fibers in the expansible paper sheet. When the content of microcapsules is less than 1%, sometimes, it is difficult to obtain an expanded paper sheet having a satisfactory density or degree of porosity. If the content of microcapsules is more than 40%, the resultant expanded paper sheet sometimes exhibits an unsatisfactory mechanical strength and an excessively lower density than 0.1 g/cm$^3$. The employment of a large amount of microcapsules causes an economical disadvantage.

The expanded paper sheet usable for the cushioning layer has a density of 0.1 to 0.4 g/cm$^3$ and preferably a basis weight of 25 to 400 g/m$^2$. When the density is more than 0.4 g/cm$^3$, the resultant cushioning layer does not exhibit a satisfactory cushioning effect or compressibility. Also, if the density is less than 0.1 g/cm$^3$, the resultant expanded paper sheet exhibits a poor mechanical strength and thus is difficult to form into a cushioning layer on the cylindrical paperboard substrate.

In the cylindrical composite paperboard cushion core of the present invention, optionally the cushioning layer is covered by an overcoat layer. The overcoat layer effectively imparts a desired color, pattern and/or performance, for example, a protective performance, an enhanced printing performance, a releasing performance and smoothing performance, to the outer surface of the cylindrical composite paperboard cushion core of the present invention. The overcoat layer can be formed by winding, around the outer surface of the cushioning layer, at least one, preferably 1 to 3, sheet materials selected from the group consisting of, for example, fine paper sheets, releasing paper sheets, metallic foils and polymer films, each having a thickness of 0.01 to 0.2 mm. The sheet materials may be colored and/or patterned.

The thickness (diameter) of the cylindrical composite paperboard cushion core of the present invention is variable depending on the use thereof. Usually, the inside diameter of the core is in the range of from 1.0 mm to 1,000 mm, and the thickness thereof is 60 to 4000 mm.

The above-mentioned cylindrical composite paperboard cushion core of the present invention can be produced by forming an expansible paper sheet from an aqueous slurry containing a mixture of pulp fibers and expansible microcapsules as mentioned above, in a paper-forming manner, heating the resultant expansible paper sheet to cause the microcapsules to be expanded and to provide an expanded paper sheet having a density of from 0.1 to 0.4 g/cm$^3$, and then coiling at least one paperboard substrate sheet and at least one expanded paper sheet obtained in the step (B) and superposed on the paperboard substrate sheet around a mandrel, to form a cylindrical composite paperboard cushion core in which a cushioning layer comprising the at least one expanded paper sheet is formed on an outer surface of a cylindrical paperboard substrate comprising the at least one paperboard substrate sheet.

In the above-mentioned process, the aqueous slurry for forming the expansible paper sheet optionally contains at least one additive selected from, for example, anionic, nonionic, cationic and amphoteric yield-enhancing agents, paper strength-enhancing agents and sizing agents and fillers. Also, a paper forming auxiliary comprising at least one member selected from dyes, pigments, pH-controlling agents, slime-controlling agents, antifoaming agents and thickening agents, is optionally added to the aqueous slurry.

Further, the expansible paper sheet or the expanded paper sheet is optionally coated with a starch, polyvinyl alcohol, surface sizing agent, or pigment by a size press method or a gate-rolling method.

In the process of the present invention, the paper-forming step (A) is carried out so as to provide an expansible paper sheet preferably having a basis weight of 25 to 400 g/m$^2$.

As mentioned above, the pulp fibers usable for the paper-forming step (A) can be selected from the group consisting of wood pulp fibers, for example, chemical pulp fibers and mechanical pulp fibers, waste paper pulp fibers, nonwood natural pulp fibers, for example, hemp pulp fibers and cotton pulp fibers, synthetic pulp fibers and mixtures of two or more types of the above-mentioned pulp fibers. The aqueous pulp slurry optionally contains non-pulp fibers, for example, organic fibers and inorganic fibers. Preferably, the content of the pulp fibers is at least 50% based on the total weight of the pulp fibers and nonpulp fibers in the aqueous slurry.

In the process of the present invention, it is preferable that the water content of the expansible paper sheet be controlled to a level of from 65% to 72% based on the weight of the paper sheet, and then subjected to the heating step (B). When the water content of the expansible paper sheet at a starting stage of the heating step (B) is less than 65%, sometimes it becomes difficult to uniformly heat the expansible paper sheet so as to allow it to evenly expand.

Also, if the water content is more than 72%, sometimes it becomes difficult to sufficiently dry and to allow the expansible paper sheet to expand within a short time.

In an embodiment of the process of the present invention, a microcapsule-containing wet paper sheet formed on a paper-forming wire net in the paper-forming procedure, is dehydrated to a water content of 65% to 72% based on the weight of the dehydrated paper sheet by a press-dehydrating procedure, and then the dehydrated expansible paper sheet is subjected to the heating step (B).

In a conventional paper-forming process, the dehydrating procedure for the wet paper sheet is carried out to such an extent that the dehydrated paper sheet has a water content of about 60% based on the weight of the dehydrated paper sheet. In the above-mentioned embodiment, the water content of the dehydrated paper sheet is controlled to a higher level of 65% to 72% than the conventional level of 60%.

In another embodiment of the process of the present invention, a microcapsule-containing wet paper sheet formed on a paper-forming wire net in the paper-forming procedure is dehydrated to a water content of 50% to 60%, for example, about 60%, based on the weight of the resultant dehydrated paper sheet, the dehydrated paper sheet is dried at a temperature lower than the expansion-starting temperature of the the microcapsules, the dried paper sheet is moistened with water to a water content of from 65% to 72% based on the weight of the resultant moistened paper sheet, and then the moistened paper sheet is subjected to the heating step (B).

In this embodiment, the dried paper sheet preferably has a water content of about 5% to about 50% based on the weight of the dried paper sheet. Also, the drying procedure is carried out by using a dryer preferably at a temperature lower than the expansion-starting temperature of the microcapsules.

For example, when Matsumoto Microsphere F-30D is used as the microcapsules, preferably, the resultant dehydrated paper sheet is dried at a temperature of 80° C. and the heating step is carried out at a temperature of from 100° C. to 160° C., more preferably 110° C. to 140° C.

This embodiment is preferably utilized when the paper-forming procedure is carried out at a high speed or when the highest temperature of the paper-forming procedure cannot be made so high. This embodiment is advantageous in that the a paper-forming machine in which a dryer, for example, a Yankee dryer, capable of being easily operated at a low speed and at a high temperature, and/or an improved paper-conveying line capable of preventing a formation of wrinkles in the expansible paper sheet, can be utilized.

In the process of the present invention, the cylindrical core-forming step (C) is carried out by coiling at least one paperboard substrate sheet and at least one expanded paper sheet superimposed on the paperboard substrate sheet around a mandrel. The paperboard substrate sheet and the expanded paper sheets are adhered to each other with an adhesive. The adhesive can be selected from animal glue, inorganic water glass, modified polyvinyl acetate resin, and thermosetting adhesives. Now, polyvinyl acetate resin emulsions are most commonly utilized as an adhesive for producing the cylindrical paperboard core. An adhesive having a high concentration of a bonding material and an appropriate viscosity exhibits a high initial adhesion and thus is useful for producing the paperboard core with a high stability and efficiency.

The adhesive is applied to the paperboard substrate sheet and/or the expanded paper sheet by using usual coating means, for example, a roll coater. The amount of the adhesive layer is preferably 10 to 40 g/m$^2$ per surface of the sheets.

Alternatively, a hot-melt bonding agent can be used as an adhesive. Further, a polyethylene film is inserted between the superimposed sheets and hot-melted to bond the sheets to each other.

The coiling procedure can be effected by a spiral coiling method or a vertical coiling method which are usually utilized to produce the conventional paperboard cores. In the spiral coiling method, the paperboard substrate sheet and the expanded paper sheet each in the form of a tape are spirally coiled together around a mandrel in a direction inclined at an angle of less than 90 degrees with respect to the longitudinal axis of the mandrel by using a spiral coiling machine. This method can produce an endless paperboard core.

In the vertical coiling method, the paperboard substrate sheet and the expanded paper sheet are coiled together around a mandrel at an angle of 90 degrees with respect to the longitudinal axis of the mandrel. In this method, the resultant paperboard core has the same length as the length of the paperboard sheet used. The spiral coiling method is now most commonly utilized. However, when a high resistance to crushing is required for the cylindrical paperboard core, the vertical coiling method is often utilized.

Also, the cushioning layer can be formed by hand coiling and adhering the expanded paper sheet around a cylindrical paperboard substrate.

The overcoat layer can be formed by coiling an overcoating sheet, for example, fine paper sheet, release paper sheet, metallic foil or polymer film, together with the paperboard substrate sheet and the expanded paper sheet, or by coating the overcoating sheet on the outer surface of the cushioning layer of the cylindrical composite paper-board cushion core. The overcoating sheet may be coiled in a single ply or in a plurality of plys, for example 2 to 3 plys, around the cushioning layer surface.

The cylindrical composite paperboard cushion core of the present invention is advantageous in that a sheet material, for example, a photographic printing paper sheet or viscose film, can be wound around the core without formation of significant stepwise marks therein, and after being used, the waste core can be reused or easily burnt with a heat generation in the same amount as that of the conventional cylindrical paperboard core and without a generation of harmful smoke and gas, whereas the conventional paperboard cushion core having a cushioning layer made from a foamed synthetic polymer sheet, for example, foamed polystyrene or polyethylene sheet, is very difficult to reuse and generates a large amount of combustion heat and harmful smoke and gas.

EXAMPLES

The present invention will be further illustrated by way of specific examples, which are merely representative and do not restrict the scope of the present invention in any way.

Example 1

An expanded paper sheet was produced by the following procedures.

An aqueous pulp slurry was prepared by dispersing 100 parts by weight of a pulp mixture consisting of 80% by weight of bleached hard wood pulp having a Canadian standard freeness (CSF) of 450 ml with 20% by weight of bleached soft wood pulp having a Canadian standard freeness (CSF) of 470 ml.

The pulp slurry was mixed with 10 parts by weight of expansible microcapsules which had a size of 10 to 20 μm and an optimum expanding temperature of 130° C. and were available under the trademark of Matsumoto Microsphere F-30D from Matsumoto Yushi K.K., 0.2 part by weight of a dry paper strength-enhancing agent which was available under the trademark of Polystron 117 from Arakawa Kagakukogyo K. K., 1.0 part by weight of a contionic starch which was available under a trademark of Cationic Starch CATO-15 from Oji National K.K., 0.03 part by weight of alkyl ketene dimer type sizing agent which was available under a trademark of Sizepine K903 from Arakawa Kagakukogyo K. K., and 0.4 part by weight of wet paper strength-enhancing agent which was available under the trademark of Kaimen 557H from DIC Hercules K. K., while fully stirring. In the resultant pulp slurry, the consistency of the pulp was controlled to 0.03% by weight and the pH of the slurry was adjusted to 7.3.

The resultant aqueous pulp slurry was fed as an inlet material to a cylinder paper machine. The wet paper sheet formed on a paper-forming wire net was dehydrated to a water content of 67% based on the weight of the dehydrated paper sheet. The dehydrated paper sheet was dry-heated at a temperature of 130° C. by a Yankee Dryer to cause the microcapsules dispersed in the resultant paper sheet to be expanded. The resultant expanded paper sheet was dried by a continuous multi-cylinder type dryer. The dried expanded paper sheet had a basis weight of 67.7 g/m$^2$, a thickness of 0.416 mm and a density of 0.16 g/cm$^3$. Also, the expanded paper sheet exhibited a compression strain of 9.8% under a compressive load of 1 kgf/cm$^2$.

Four class B paperboard substrate sheets each having a density of 0.68 g/cm3 and a thickness of 1.0 mm were used to form a cylindrical paperboard substrate. Also, two expanded paper sheets were used to form a cushioning layer.

The two expanded paper sheets and the four paperboard substrate sheets were superimposed on each other and spirally coiled around a mandrel having a diameter of 55 mm at a speed of 20 m/min by using a spril type core machine (made by Langstone Co.), while adhering the sheets to each other through adhesive layers each having a bone dry weight of 20 g/m$^3$. The adhesive layers were formed from a polyvinyl acetate emulsion adhesive which was available under a trademark of ACE-600M, from Oji Kenzai K. K.

The resultant cylindrical composite paperboard cushion core had an inside diameter of 55mm and a thickness of 5 mm.

A photographic printing paper having a basis weight of 245 g/m$^2$ and a thickness of 0.26 mm in a length of 50 m was wound around the cylindrical composite paperboard cushion core under a tension of about 10 kg/cm, and left standing at a temperature of 40° C. for 72 hours to confirm the cushioning effect of the cylindrical core, the number of the stepwise marks formed in the initial terminal portion of the wound photographic printing paper sheet was counted.

The test results are shown in Table 1.

Example 2

A cylindrical composite paperboard cushion core was produced in the same manner as in Example 1, except that the expanded paper sheet had a basis weight of 151 g/m$^2$, a thickness of 0.838 mm and a density of 0.18 g/cm$^3$.

The test results are shown in Table 1.

Comparative Example 1

A cylindrical paperboard core was produced from only the same paperboard substrate sheets as in Example 1. Namely, no cushioning layer was formed from the expanded paper sheets.

The test results are shown in Table 1.

Comparative Example 2

A cylindrical composite paperboard cushion core was produced in the same manner as in Example, except that the expanded paper sheets were replaced by foamed polystyrene sheets having a basis weight of 65 g/m$^2$ and a density of 0.063 g/cm$^3$. In the foamed polystyrene sheets, a compressive strain of 9.8% was generated under a compressive load of 0.52 kgf/cm$^2$.

The test results are shown in Table 1.

TABLE 1

| | Item | | | | |
|---|---|---|---|---|---|
| | Expanded paper sheet for cushioning layer | | | Number | |
| Example No. | Basis weight (g/m$^2$) | Thickness (μm) | Density (g/cm$^3$) | of stepwise marks | Remarks |
| Example | | | | | |
| 1 | 67.7 | 416 | 0.16 | 3 | — |
| 2 | 151.0 | 838 | 0.18 | 3 | — |
| Comparative Example | | | | | |
| 1 | — | — | — | 10 | No cushioning layer |
| 2 | 65.0 | 1063 | 0.063 | 2 | Polystyrene foam sheets were used |

Table 1 clearly shows that the cylindrical composite paperboard cushion cores of Examples 1 and 2 each having a cushioning layer made from the expanded paper sheets exhibited a cushioning effect similar to that of Comparative Example 2 using the conventional foamed polystyrene sheets.

We claim:

1. A cylindrical composite paperboard cushion core comprising:

(A) a cylindrical paperboard substrate; and (B) a cushioning layer covering an outer surface of the cylindrical paperboard substrate and comprising at least one expanded paper sheet having a density of 0.1 to 0.4 g/cm$^3$, said expanded paper sheet having been formed by subjecting an aqueous slurry of a mixture of pulp fibers or pulp-nonpulp mixture fibers containing at least 50% by weight of pulp with a plurality of expansible microcapsules in an amount of 1 to 40% by weight based on the weight of the pulp fibers, said microcapsules each having a volatile liquid core enclosed in a thermoplastic resin shell and capable of starting an expansion at a temperature of from 80° C. to 200° C. to a paper-forming procedure, and heating the resultant paper sheet at the expansion starting temperature of the microcapsules or higher to cause the paper sheet to be expanded.

2. The cylindrical composite paperboard cushion core as claimed in claim 1, wherein the expansible microcapsules have an average size of from 10 to 30 μm.

3. The cylindrical composite paperboard cushion core as claimed in claim 1, wherein the liquid cores of the expansible microcapsules comprise at least one member selected from the group consisting of isobutane, pentane, petroleum ether, hexane, halogenated hydrocarbons, and methylsilane.

4. The cylindrical composite paperboard cushion core as claimed in claim 1, wherein the thermoplastic resin shells of the expansible microcapsules comprise at least one member selected from the group consisting of homopolymers of vinylidene chloride, acrylonitrile, acrylic acid esters and methacrylic esters and copolymers of two or more of the above-mentioned monomers.

5. The cylindrical composite paperboard core as claimed in claim 1, wherein the expanded paper sheet has a basis weight of 25 to 400 g/m$^2$.

6. The cylindrical composite paperboard cushion core as claimed in claim 1, wherein the cushioning layer is covered by an overcoat layer comprising at least one member selected from the group consisting of fine paper sheets, release paper sheets, metallic foils and polymer films each having a thickness of 0.01 to 0.2 mm.

7. The cylindrical composite paperboard cushion core as claimed in claim 1, which has an inside diameter of 1 mm to 1000 mm.

8. The cylindrical composite paperboard cushion core as claimed in claim 1, wherein the pulp fibers for the expanded paper sheet are selected from the group consisting of wood pulp fibers, waste paper pulp fibers, nonwood natural pulp fibers, synthetic pulp fibers, nonwood natural pulp fibers, synthetic pulp fibers, and mixtures of at least one of the pulp fibers with at least one type of non-pulp fibers.

* * * * *